US007770664B2

(12) United States Patent
Laird et al.

(10) Patent No.: US 7,770,664 B2
(45) Date of Patent: Aug. 10, 2010

(54) WEAR INDICATORS FOR EXPANDABLE EARTH BORING APPARATUS

(75) Inventors: Tommy Laird, Cypress, TX (US); Gordon Whipple, Spring, TX (US)

(73) Assignee: Smith International, Inc., Houston, TX (US)

( * ) Notice: Subject to any disclaimer, the term of this patent is extended or adjusted under 35 U.S.C. 154(b) by 68 days.

(21) Appl. No.: 12/129,540

(22) Filed: May 29, 2008

(65) Prior Publication Data

US 2009/0294173 A1 Dec. 3, 2009

(51) Int. Cl.
*E21B 12/02* (2006.01)

(52) U.S. Cl. ..... 175/57; 175/39; 175/284

(58) Field of Classification Search ..... 175/39, 175/57, 284, 406
See application file for complete search history.

(56) References Cited

U.S. PATENT DOCUMENTS 2,657,909 A * 11/1953 Bielstein ..... 175/39
3,306,381 A * 2/1967 Garrett et al. ..... 175/346
4,189,012 A * 2/1980 Garrett ..... 175/312
6,189,631 B1 * 2/2001 Sheshtawy ..... 175/284
6,732,817 B2 * 5/2004 Dewey et al. ..... 175/57
7,549,485 B2 * 6/2009 Radford et al. ..... 175/57
7,594,552 B2 * 9/2009 Radford et al. ..... 175/269
2005/0087371 A1 * 4/2005 Kembaiyan ..... 175/435
2005/0145417 A1 * 7/2005 Radford et al. ..... 175/57
2009/0044984 A1 * 2/2009 Massey et al. ..... 175/374
2009/0055135 A1 * 2/2009 Tang et al. ..... 703/1

OTHER PUBLICATIONS

International Search Report and Written Opinion in corresponding European patent application #PCT/US2009/043879 dated Jan. 6, 2010. (10 pages).

* cited by examiner

*Primary Examiner*—Shane Bomar
(74) *Attorney, Agent, or Firm*—Osha Liang LLP

(57) ABSTRACT

An expandable underreamer apparatus disposed on a distal end of a drillstring and configured to drill a formation includes a substantially tubular main body adjacent a cutting head, the main body providing at least one axial recess configured to receive an arm assembly, and the arm assembly configured to translate between a retracted position and an extended position. The apparatus further includes a plurality of cutting elements disposed on the arm assembly, and a plurality of wear indicators imbedded in at least one arm assembly and positioned behind the cutting elements with respect to a direction of rotation of the arm assembly, wherein the wear indicators are configured to provide an increased torque to the drillstring upon contacting the formation.

20 Claims, 3 Drawing Sheets

WEAR INDICATORS FOR EXPANDABLE EARTH BORING APPARATUS

BACKGROUND

1. Field of the Disclosure

Embodiments disclosed herein relate generally to apparatus and methods involved in cutting tools for oilfield applications. More particularly, embodiments disclosed herein relate to apparatus and methods for wear indicators on an expandable underreamer.

2. Background Art

In the drilling of oil and gas wells, typically concentric casing strings are installed and cemented in the borehole as drilling progresses to increasing depths. Each new casing string is supported within the previously installed casing string, thereby limiting the annular area available for the cementing operation. Further, as successively smaller diameter casing strings are suspended, the flow area for the production of oil and gas is reduced. Therefore, to increase the annular space for the cementing operation, and to increase the production flow area, it is often desirable to enlarge the borehole below the terminal end of the previously cased borehole. By enlarging the borehole, a larger annular area is provided for subsequently installing and cementing a larger casing string than would have been possible otherwise. Accordingly, by enlarging the borehole below the previously cased borehole, the bottom of the formation can be reached with comparatively larger diameter casing, thereby providing more flow area for the production of oil and gas.

Various methods have been devised for passing a drilling assembly through a cased borehole, or in conjunction with expandable casing to enlarging the borehole. One such method involves the use of an underreamer, which has basically two operative states —a closed or collapsed state, where the diameter of the tool is sufficiently small to allow the tool to pass through the existing cased borehole, and an open or partly expanded state, where one or more arms with cutters on the ends thereof extend from the body of the tool. In this latter position, the underreamer enlarges the borehole diameter as the tool is rotated and lowered in the borehole.

A "drilling type" underreamer is one that is typically used in conjunction with a conventional "pilot" drill bit positioned below (i.e. downstream of) the underreamer. Typically, the pilot bit drills the borehole to a reduced gauge, while the underreamer, positioned behind the pilot bit, simultaneously enlarges the pilot borehole to full gauge. Furthermore, it is conventional to employ a tool known as a "stabilizer" in drilling operations. In standard boreholes, traditional stabilizers are located in the drilling assembly behind the drill bit to control and maintain the trajectory of the drill bit as drilling progresses.

In a conventional rotary drilling assembly, a drill bit may be mounted onto a lower stabilizer, which may be disposed approximately 5 or more feet above the bit. Typically the lower stabilizer is a fixed blade stabilizer and includes a plurality of concentric blades extending radially outwardly and azimuthally spaced around the circumference of the stabilizer housing. The outer edges of the blades are adapted to contact the wall of the existing cased borehole, thereby defining the maximum stabilizer diameter that will pass through the casing. A plurality of drill collars extends between the lower and other stabilizers in the drilling assembly. An upper stabilizer is typically positioned in the drill string approximately 30-60 feet above the lower stabilizer.

A typical drilling apparatus 10 is shown in FIGS. 1A and 1B. Drilling apparatus includes a drill bit 20 disposed on the distal end of a drillstring 15, an expandable lower stabilizer/underreamer assembly 30, a drill collar 40, and an upper stabilizer 50. FIG. 1B shows expandable underreamer 30 which includes cutting elements 32 and a stabilizer pad 34. Expandable underreamer 30 is configured to travel along grooves 36 during expansion or retraction of the arms.

During underreaming operations, the cutting elements of the underreamer may wear down from the continued contact with the formation to a point at which they are no longer effective. In this condition, the cutting elements do not properly remove material from the formation, and thus affecting the gauge diameter of the bore by reducing the diameter at which it is being underreamed. This may lead to further problems when the casing is run into the bore and the gauge diameter is too small. Accordingly, there exists a need for an apparatus and/or a method to indicate to an operator when the cutting elements are no longer effectively underreaming the bore to the proper gauge diameter.

SUMMARY OF THE DISCLOSURE

In one aspect, embodiments disclosed herein relate to an expandable underreamer apparatus disposed on a distal end of a drillstring and configured to drill a formation, the expandable drilling apparatus including a substantially tubular main body adjacent a cutting head, the main body providing at least one axial recess configured to receive an arm assembly, and the arm assembly configured to translate between a retracted position and an extended position. The apparatus further includes a plurality of cutting elements disposed on the arm assembly, and a plurality of wear indicators imbedded in at least one arm assembly and positioned behind the cutting elements with respect to a direction of rotation of the arm assembly, wherein the wear indicators are configured to provide an increased torque to the drillstring upon contacting the formation.

In another aspect, embodiments disclosed herein relate to a method to indicate the wear of cutting elements of an expandable underreamer apparatus disposed on a drillstring, the method including running the expandable underreamer apparatus into a formation and contacting a plurality of cutting elements disposed on the underreamer with the formation. The method further includes providing a plurality of wear indicators on at least one arm assembly of the underreamer, the wear indicators configured to contact the formation when the cutting elements are worn to a specific height, monitoring a torque increase of the drillstring, wherein the torque increase is caused by contact of the wear indicators with the formation, and removing the expandable underreamer from the formation when the torque increases by a specified amount.

Other aspects and advantages of the invention will be apparent from the following description and the appended claims.

DETAILED DESCRIPTION

In one aspect, embodiments disclosed herein relate to apparatus and methods for indicating wear of the cutting elements during underreaming operations.

Figure 2A:
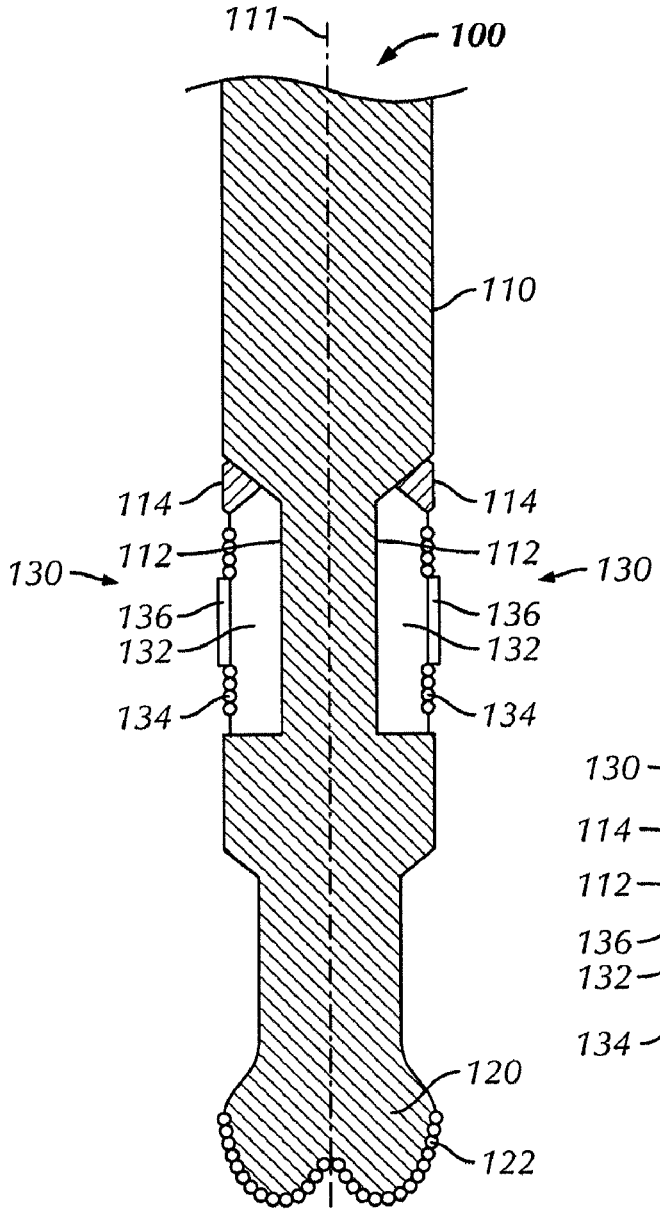
FIGS. 2A and 2B show an underreamer in a retracted and expanded position in accordance with embodiments of the present disclosure.
Figure 2B:
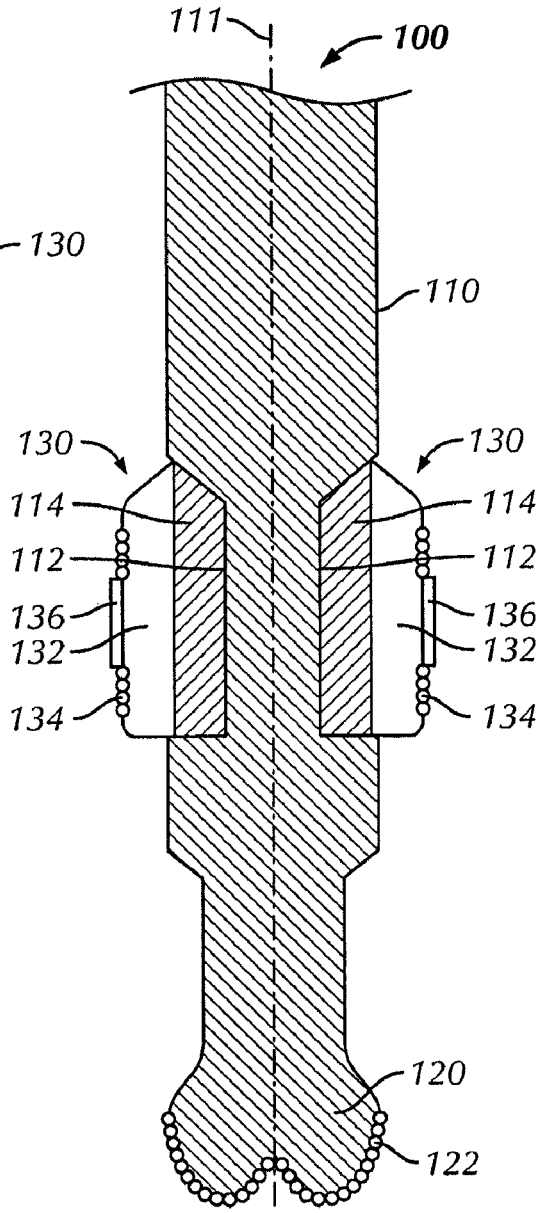

Referring to FIGS. 2A and 2B, a section view of a lower end of a drilling assembly 100 is shown in accordance with embodiments of the present disclosure. Drilling assembly 100 is shown having a substantially tubular main body 110 having a central axis 111, a cutting head 120, and an expandable underreamer 130. Cutting head 120 includes a plurality of cutting elements, or polycrystalline diamond compact ("PDC") cutters 122. Main body 110 of drilling assembly 100 includes a plurality of axial recesses 112 in which arm assemblies 132 of underreamer 130 are located. Arm assemblies 132 include cutting elements 134, and in certain embodiments, also include stabilizer pads 136.

Arm assemblies 132 travel from their retracted position (FIG. 2A) to their extended position (FIG. 2B) along a plurality of grooves 114 within the wall of axial recesses 112. Corresponding grooves (not shown) of arm assemblies 132 engage grooves 114 and guide arm assemblies 112 as they traverse in and out of axial recesses 112. One of ordinary skill in the art will understand that any number of arm assemblies 132 may be employed, from a single arm assembly 132 to as many arm assemblies 132 as the size and geometry of main body 110 may accommodate. Furthermore, while each arm assembly 132 is depicted with both stabilizer pads 136 and cutting elements 134, it should be understood that arm assemblies 132 may include stabilizer pads 136, cutting elements 134, or a combination thereof in any proportion appropriate for the type of operation to be performed.

Figure 1A:
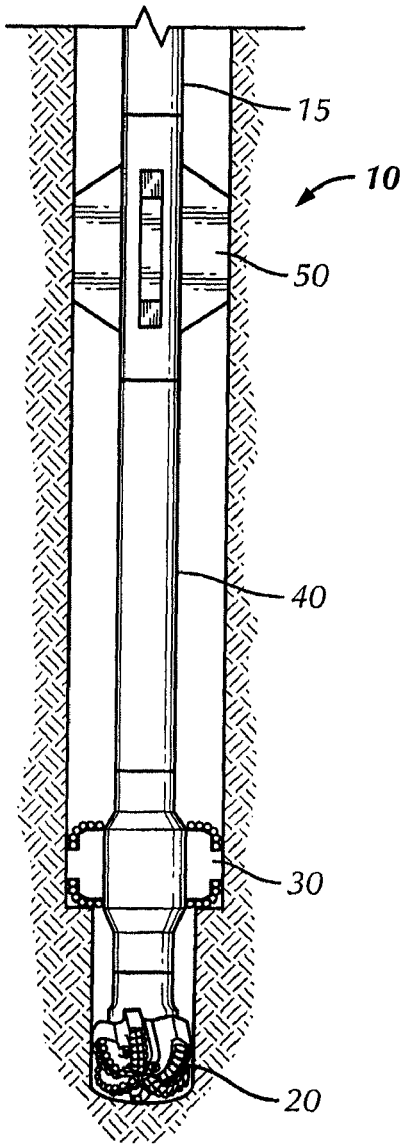
FIG. 1A (Prior Art)
FIGS. 1A and 1B show a drillstring with an underreamer in accordance with prior art.
Figure 1B:
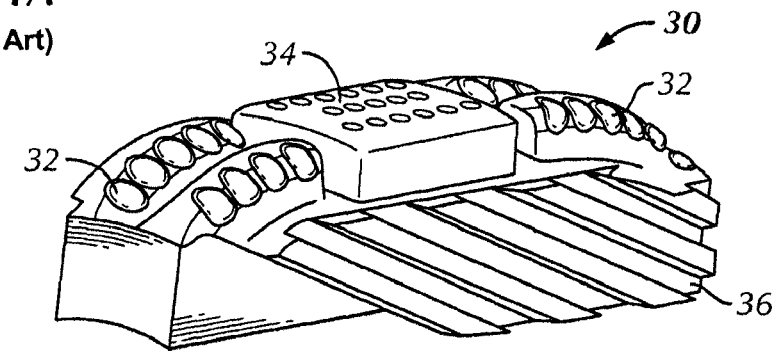
FIG. 1B (Prior Art)

During drilling operations, cutting head 120 is designed and sized to cut a pilot bore, or a bore that is large enough to allow drilling assembly 100 in its retracted state (FIG. 1) and remaining components of the drillstring to pass therethrough. In circumstances where the borehole is to be extended below a string of casing, the geometry and size of cutting structure 120 and main body 110 is such that entire drilling assembly 100 may pass clear of the casing string without becoming stuck. Once clear of the casing string, or when a larger diameter borehole is desired, arm assemblies 132 are extended and cutting elements 134 disposed thereupon (in conjunction with stabilizer pads 136) underream the pilot bore to the final gauge diameter.

Figure 3:
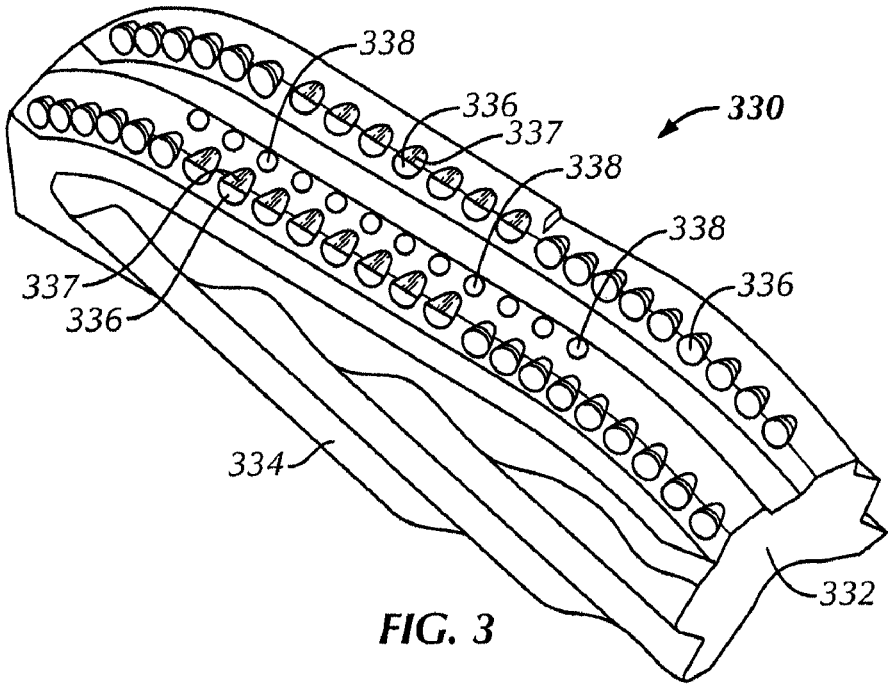
FIG. 3 shows an arm assembly of an underreamer with wear indicators in accordance with embodiments of the present disclosure

Referring now to FIG. 3, a component view of an arm assembly 332 of an underreamer 330 is shown in accordance with embodiments of the present disclosure. Arm assembly 332 includes grooves 334 configured to engage grooves (114 in FIGS. 2A and 2B) when extending out of or retracting into axial recesses (112 in FIGS. 2A and 2B). Arm assembly also includes cutting elements 336 which are configured to underream the formation when arm assembly 332 is in the expanded position (FIG. 2B). In certain embodiments, arm assembly 332 may be coated with a high velocity oxygen fuel ("HVOF"), a thermal spray which adds increased hardness to the surface.

Cutting elements 336 are positioned along a length of arm assembly 332 and are configured as the "primary" cutting structures of underreamer 330. They may be mounted in arm assembly 332 by welding, brazing, press fit, or other mounting methods known to those skilled in the art. Further, certain cutting elements 336 which are positioned at the gauge diameter section of arm assembly 332 may be configured with "pre-flats" 337 to provide a quicker cut of the formation. Pre-flats 337 may be machined onto cutting elements 336 prior to mounting cutting elements 336 on arm assembly 332, or alternatively, may be machined after cutting elements 336 are mounted to provide "even" pre-flats 337 on cutting elements 336 as they are mounted on arm assembly 332.

Arm assembly 332 further includes wear indicators 338 which are lined along the length of arm assembly 332. Wear indicators 338 may be attached to arm assembly 332 by brazing, adhesives, or other attachment methods known to those skilled in the art. Wear indicators 338 may be diamond enhanced wear studs with PDC inserts, tungsten carbide inserts ("TCIs"), grit hot pressed inserts ("GHIs"), or other insert materials known to a person skilled in the art. Wear indicators 338 may be configured in a dome-shape or other appropriate shapes known to a person skilled in the art.

Wear indicators 338 are positioned "behind" cutting elements 336; that is, during rotation of underreamer 330, a cutting element 336 will contact the formation ahead of a wear indicator 338. Wear indicators 338 are also positioned at a smaller gauge diameter on each arm assembly 332 of underreamer 330 than cutting elements 336, and thus are positioned at a lower "height" than cutting elements 336. Height refers to the distance between the surface of arm assembly 332 and an upper surface of cutting element 336 or wear indicator 338. The cutting element gauge diameter and the wear indicator gauge diameter may be defined as the diameter formed by the rotation of cutting elements 336 and wear indicators 338, respectively, in the borehole. In certain embodiments, wear indicators 338 are set below cutting elements 336 by about 25% to 30% of the initial height of the cutting elements 336. The initial height of cutting elements 336 may be defined as the height of cutting elements 336 when they are first installed on arm assembly 332 and before they have been put into use. Wear indicators 338 may be set at this particular height (25-30% below cutting elements) due to the ineffectiveness of cutting elements 336 once they are worn down 25% to 30% of their initial height, as will be known to those skilled in the art.

For example, in this case, cutting elements 336 must wear down to a height that is 25% to 30% of their initial height before wear indicators 338 may come into contact with the formation. Because wear indicators 338 are set lower than cutting elements 336, initially during operation, wear indicators 338 should not be in contact with formation. As the underreaming operation continues, cutting elements 336 may wear down to a height, or to a gauge diameter equal to the wear indicator gauge diameter. When cutting elements 336 are worn down to substantially the same gauge diameter as wear indicators 338, wear indicators 338 may then contact the formation.

In certain embodiments, different cutting elements 336 may be used on underreamer 330 which may exhibit varied wear characteristics. For example, various cutting elements 336 may have different profiles or may be manufactured from different materials, and therefore may have different wear rates. As such, wear indicators 338 may need to be positioned according to the wear rate of the selected cutting elements 336 in order to indicate wear of cutting elements 336. A person skilled in the art will understand the wear characteristics of different cutting elements 336, and be able to position wear indicators 338 at an appropriate height below cutting elements 336.

In operation, cutting elements 336 of underreamer 330 contact the formation being drilled to remove material and enlarge the borehole. Due to continued contact with the formation, cutting elements 336 may gradually wear down to a point at which they are no longer effective in underreaming the borehole. Wear indicators 338 are configured to contact the formation when cutting elements 336 have worn down to a specified height. Thus, the specified height to which cutting elements 336 may wear down to corresponds to a height at which cutting elements 336 are no longer effective in properly underreaming the borehole Wear indicators 338 are configured to provide an increased torque to the drillstring after contacting the formation. The increased torque on the drillstring is caused by the increased area provided by wear indicators 338 that is now in contact with the formation.

In certain embodiments, wear indicators 338 may provide an increase in torque of about 20-25% of normal operating torque experienced by the drillstring. Initially, only a slight increase in torque may be experienced as cutting elements 336 engage the formation, followed by greater increases in the torque as the wear of cutting elements 336 continues. Those skilled in the art will recognize the amount of increased torque on the drillstring indicating wear of cutting elements 336.

The amount of torque increase experienced by the drillstring to indicate the drillstring should be removed from the borehole may be calibrated to be large enough so as not to be affected by smaller torque increases. For example, a smaller 5% or 10% increase in the torque experienced by the drillstring will not indicate the time for removal of the underreamer from the borehole. However, a 20-25% torque increase as mentioned above, is a large enough torque increase to inform the operator that wear indicators 338 are in full contact with the formation, and the drillstring should be removed to replace worn arm assemblies of the underreamer with new arm assemblies.

The drillstring torque may be monitored by an operator to indicate an increase in the torque on the drillstring. The operator may then stop operation and remove the drillstring from the borehole upon receiving an indication of the torque increase. Torque monitoring of the drillstring is common in drilling and/or underreaming operations, and therefore should be well understood by those skilled in the art. Further, various torque measurement and monitoring devices may be used, as well as various indicators which show an increased torque. Torque indicators may include an analog gauge, a digital gauge, a warning light indicator, sound indicator, or other devices as will be known to those skilled in the art.

In certain embodiments, wear indicators 338 may be configured as "secondary" cutting elements on underreamer 330. After primary cutting elements 336 have worn to a specified height, and wear indicators 338 have contacted the formation, an increased torque may be applied to the drillstring as previously described. Further, wear indicators 338 may provide some cutting action on the formation in an attempt to aid primary cutting elements 336 until underreamer 330 may be removed from the borehole. Still further, in certain embodiments, wear indicators 338 may be mounted on only certain arm assemblies 332 of underreamer 330. Wear indicators 338 may be mounted on opposite arm assemblies 332 as arranged on underreamer 330 to promote balance of underreamer 330 during operation and prevent undesirable effects such as bit whirl.

Figure 4:
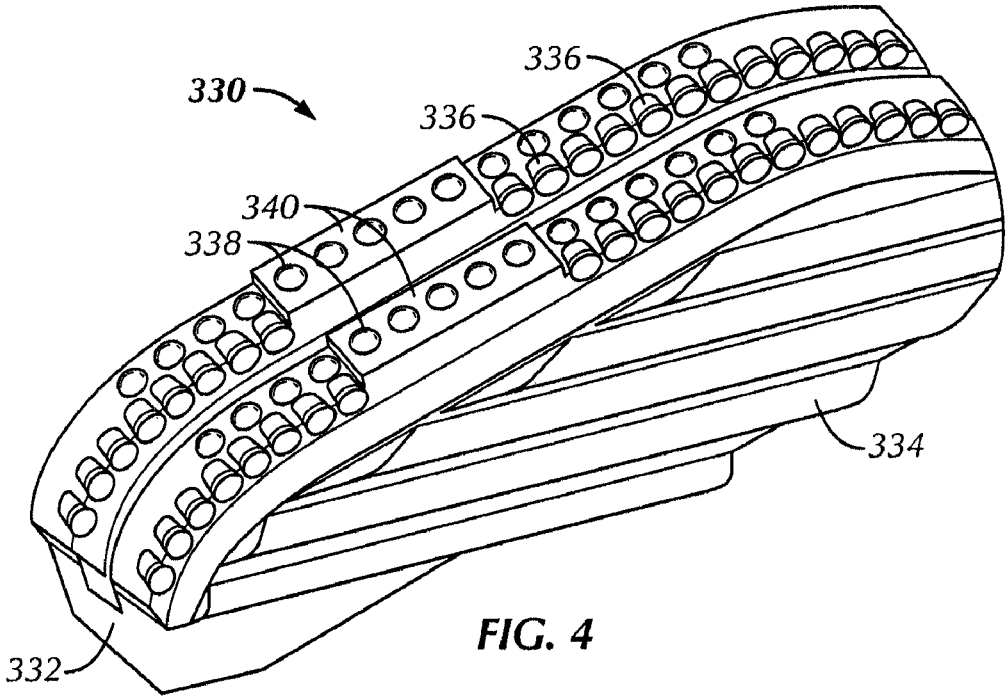
FIG. 4 shows an arm assembly of an underreamer which includes a central stabilizer portion and with wear indicators in accordance with alternative embodiments of the present disclosure.

Referring now to FIG. 4, a component view of an arm assembly 332 of an underreamer 330 is shown in accordance with alternate embodiments of the present disclosure. Arm assembly 332 includes cutting elements 336 which are positioned along arm assembly 332, and wear indicators 338 which are positioned behind cutting elements 336. As previously mentioned, certain underreamers 330 may also include a stabilizer portion 340 which is used to help control and maintain the trajectory of the drill bit as drilling and/or underreaming progresses. Stabilizer portion 340 is configured at a lower height, or gauge diameter, than cutting elements 336 and has wear indicators 338 disposed thereon. Thus, when cutting elements 336 have worn down to the height of stabilizer portion 340, wear indicators 338 on stabilizer portion 340 may provide increased torque along with wear indicators 338 behind cutting elements 336. Further, wear indicators 338 located on stabilizer portion 340 may be configured to help reduce wear and erosion of stabilizer pad 340 during underreaming operations.

As previously described, wear indicators 338 are set below cutting elements 336 by about 25% to 30% of the initial height of the cutting elements 336. Therefore, cutting elements 336 must wear down to a height that is 25% to 30% of their initial height before wear indicators 338 may come into contact with the formation. Also, as previously described, cutting elements 336 may wear down to a specified height, at which point, wear indicators 338 may contact the formation and provide a torque increase to the drillstring, which is indicated to an operator. Wear indicators 338 may provide an increase in torque of about 20-25% of normal operating torque experienced by the drillstring.

Advantageously, embodiments of the present disclosure may help to provide indication that the cutting elements have worn down to a specified height and are no longer effectively underreaming the borehole. Without a wear indicator feature, it may be difficult for an operator to know when the underreamer is not properly enlarging the borehole to a fall gauge diameter. Oftentimes, the underreamer may be pulled from the borehole, after which it may be found that for some distance the borehole was not properly underreamed due to worn cutting elements. The underreamer may then be replaced and required to underream sections of the borehole that were not underreamed to a proper gauge diameter. This requires extra drilling time to go back in and properly underream the borehole.

Embodiments disclosed herein provide underreamers with wear indicators, such that only one drilling pass may be required and the borehole is underreamed properly the first time. At the first indication of overly worn cutting elements, the drillstring may be removed from the borehole and the arm assemblies of the underreamer replaced. This may lead to savings in drilling time, rig costs, and equipment costs.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. An expandable underreamer apparatus disposed on a distal end of a drillstring and configured to drill a formation, the expandable drilling apparatus comprising:

a substantially tubular main body adjacent a cutting head, the main body providing at least one axial recess configured to receive an arm assembly;

the arm assembly configured to translate between a retracted position and an extended position;

a plurality of cutting elements disposed on the arm assembly;

a plurality of wear indicators imbedded in at least one arm assembly and positioned behind the cutting elements with respect to a direction of rotation of the arm assembly;

wherein the plurality of wear indicators are positioned at a smaller gauge diameter than the plurality of cutting elements;

wherein the wear indicators are configured to provide an increased torque to the drillstring and secondary cutting action upon contacting the formation.

2. The apparatus of claim 1, wherein the wear indicators comprise diamond enhanced wear studs.

3. The apparatus of claim 1, wherein the wear indicators comprise tungsten carbide inserts.

4. The apparatus of claim 1, wherein the wear indicators comprise grit hot-pressed inserts.

5. The apparatus of claim 1, further comprising a torque sensor and corresponding torque indicator.

6. The apparatus of claim 1, wherein the wear indicators are set below the cutting elements in the arm assembly at 25% to 30% of an initial height of the cutting elements.

7. The apparatus of claim 1, wherein the wear indicators contact the formation when the cutting elements are worn down to a height of between 25% and 30% of their initial height.

8. The apparatus of claim 1, wherein the wear indicators provide a torque increase to the drillstring of about 20% to 25% of a normal operating torque after contacting the formation.

9. The apparatus of claim 1, wherein the wear indicators are configured as secondary cutting elements.

10. The apparatus of claim 1, wherein the arm assembly is coated with a high velocity oxygen fuel.

11. The apparatus of claim 1, further comprising a stabilizer portion located in the center of the arm assembly, the stabilizer portion having additional wear indicators mounted thereon.

12. The apparatus of claim 11, wherein the wear indicators mounted on the stabilizer portion are configured to reduce wear of the stabilizer portion.

13. The apparatus of claim 11, wherein the stabilizer portion is configured with a smaller gauge diameter than the cutting element gauge diameter.

14. A method to indicate the wear of cutting elements of an expandable underreamer apparatus disposed on a drillstring, the method comprising:

running the expandable underreamer apparatus into a formation and contacting a plurality of cutting elements disposed on the underreamer with the formation;

providing a plurality of wear indicators on at least one arm assembly of the underreamer, the wear indicators configured to contact the formation when the plurality of cutting elements are worn to a specific height;

wherein the plurality of wear indicators are positioned at a smaller gauge diameter than the plurality of cutting elements;

monitoring a torque increase of the drillstring, wherein the torque increase is caused by contact of the wear indicators with the formation;

providing secondary cutting action with the plurality of wear indicators in contact with the formation, removing the expandable underreamer from the formation when the torque increases by a specified amount.

15. The method of claim 14, further comprising replacing the arm assembly having the worn cutting elements with a new arm assembly after removing the underreamer from the formation.

16. The method of claim 14, further comprising maintaining a specified hole diameter in the formation with the expandable underreamer apparatus.

17. The method of claim 14, wherein the cutting elements are configured to wear down 25% to 30% of their initial height before the wear indicators contact the formation.

18. The method of claim 14, wherein the torque applied to the expandable underreamer increases by 20% to 25% of the normal operating torque after the wear elements contact the formation.

19. The method of claim 14, wherein the wear indicators are configured as secondary cutting elements.

20. The method of claim 14, further comprising disposing additional wear indicators on a central stabilizer portion to reduce wear of the stabilizer portion.

* * * * *